United States Patent [19]

Allen

[11] Patent Number: 4,865,097

[45] Date of Patent: Sep. 12, 1989

[54] ANTIQUE DOLL PROTECTION SYSTEM

[76] Inventor: Patricia L. Allen, 1708 W. Monte Ave., Mesa, Ariz. 85201

[21] Appl. No.: 287,871

[22] Filed: Dec. 20, 1988

[51] Int. Cl.[4] ..... B65D 65/10; B65D 65/22

[52] U.S. Cl. ..... 150/154; 206/478; 206/495; 446/268

[58] Field of Search ..... 150/154, 901; 2/69.5; 206/37 R, 478, 373, 292, 278, 495, 548, 805; 229/87.5; 446/268; 383/4; 190/2

[56] References Cited

U.S. PATENT DOCUMENTS

| | | | |
|---|---|---|---|
| D. 152,173 | 12/1948 | Seidler | D58/2 |
| D. 153,464 | 4/1949 | Rubenstein | D44/29 |
| 606,332 | 7/1898 | Cummins . | |
| 857,435 | 6/1907 | Bell . | |
| 1,068,066 | 7/1913 | Martin . | |
| 1,407,165 | 2/1922 | Pajeau . | |
| 1,429,608 | 9/1922 | May | 206/292 |
| 1,434,279 | 10/1922 | Baum | 206/278 X |
| 1,581,535 | 4/1926 | Granger . | |
| 1,647,169 | 11/1927 | Anton | 150/154 |
| 1,736,383 | 11/1929 | Waggoner | 150/154 |
| 1,822,899 | 9/1931 | Malis . | |
| 1,863,256 | 7/1932 | Snoddy . | |
| 2,445,487 | 7/1948 | Lester et al. | 2/174 |
| 3,034,132 | 5/1962 | Landsberger et al. | 2/69.5 |
| 3,586,349 | 7/1971 | Green et al. | 281/31 |
| 3,674,139 | 7/1972 | Manasian et al. | 206/83.5 |
| 3,789,546 | 2/1974 | Morrison | 446/268 X |
| 3,811,565 | 5/1974 | Tancredi | 206/478 |
| 4,180,114 | 12/1979 | Katz | 383/4 X |
| 4,334,612 | 6/1982 | Beato | 206/373 X |
| 4,674,787 | 6/1987 | DeVera | 150/154 X |
| 4,682,691 | 7/1987 | Spiering | 206/373 |

*Primary Examiner*—Sue A. Weaver

*Attorney, Agent, or Firm*—Cahill, Sutton & Thomas

[57] ABSTRACT

A protection system includes a body cover capable of being wrapped around an antique doll to form a generally tubular protective wrap. The body cover includes first and second spaced apart body ties for securing the body cover to the doll body section. First and second exterior tie straps are positionable around the outer surface of the body cover to maintain the body cover tightly wrapped around the doll. A pair of bootlets pass over and protect the shoes and feet of the doll. A head cover is provided to cover and protect the doll's head. A pair of hand mitts are provided to cover and protect the doll's hands and fingers.

16 Claims, 1 Drawing Sheet

ANTIQUE DOLL PROTECTION SYSTEM

BACKGROUND OF THE INVENTION

1. Field of the Invention

This invention relates to protective storage systems for dolls, and more particularly, to a protective system for antique dolls including a body cover which is wrapped around the doll.

2. Description of the Prior Art

Antique dolls have in recent years become highly valuable collectors' items. The value of such dolls has risen approximately twenty percent per year since the early 1970's. Due to the age of such dolls, both the doll body, its head and its extremities as well as its wig and each item of clothing are extremely fragile and prone to breakage or damage.

Many antique dolls utilize bisque heads made from a form of porcelain clay which has been baked into a highly brittle form. A bisque doll head includes a hollow interior with a thin walled surface. An aperture is included in the rear wall of the head for the purpose of inserting eyes during original manufacture. Glass eyes are installed through the open back of the doll head and are attached to the doll head by small globs of plaster.

The bisque heads of antique dolls can readily crack or be shattered. When stored or moved, an antique doll should be placed face down to permit the comparatively heavy weight of the glass eyes to be supported by the eye apertures of the bisque head. If stored or transported face up, the weight of the glass eyes pulls them away from the doll face and can break the plaster maintaining them in place. If the doll eye becomes detached from the head, it can fall back onto and break the bisque head as well as the eye itself. Antique dolls with cracked or broken heads or with glass eyes which have been reset or replaced have less value than original condition dolls.

The value of antique dolls is based on an overall analysis of the entire doll, including the condition of the doll body, its wig and clothing.

The body sections of antique dolls are typically fabricated as either composition bodies or leather bodies. Composition bodies are fabricated from paper mache and wood painted with a flesh tone. Composition bodies may also be fabricated from paper pulp or wood pulp and glue. Such composition bodies can readily break. The fingers of such doll bodies are particularly prone to damage. The paint used to impart the appropriate coloration to composition doll bodies can readily chip and flake. Any such damage significantly reduces the value of an antique doll.

A second type of antique doll includes a leather body fabricated from a leather shell stuffed with sawdust or shredded cork and includes arms and hands made of bisque. Frequently, the lower legs of leather bodied antique dolls are also made from bisque. Each component of such leather bodied antique dolls can readily be damaged or broken, substantially reducing the market value of the doll.

Antique bisque head dolls include wigs made either from human hair, mohair or sheep skin. Due to age, doll wigs are fragile and difficult to replace or repair. Constant mussing of an old wig causes matting and can ruin the original hair style. It is therefore critically important to provide protection not only for the head of the doll, but also for its high value wig.

Antique doll clothes represent an important part of the value of the doll. The fabric in antique dolls is fragile and easily shreds or tears. Due to these problems, it is preferable to maintain the doll clothing as undisturbed as possible during storage or transport to maximize the value of the doll.

The original shoes and socks on antique dolls are valuable, very rare and almost impossible to replace. The leather and fasteners used in antique doll shoes are typically brittle and do not fit tightly or securely on the doll's foot. It is therefore important to prevent either damage or loss to these important antique doll accessories.

The growing number of individuals involved in antique doll collecting and resale have been well aware of the breakage, alteration and loss problems described above and have attempted to solve these problems by relying on protective covers such as paper, Turkish towels and disposable baby diapers. When an antique doll is wrapped up in a Turkish towel, it is impossible to determine which way the doll's head is facing. It is therefore impossible to properly place the doll face down to minimize potential eye/head damage with any such doll wrapping. The brittle composition fingers of antique dolls are readily snapped off and caught on the toweling material when a doll is wrapped or unwrapped. Antique dresses are damaged and shoes and socks lost as a doll is rolled up inside a Turkish towel or disposable paper diapers. Antique doll wigs are frequently mussed and matted by such prior art protection systems. Utilization of such unacceptable prior art doll protection systems has damaged dolls and caused substantial value reductions.

None of these crude, primitive prior art antique doll protection systems have provided an integrated system which deals with each individual potential doll damage site as described above. Instead such prior art systems have caused damage either to the doll clothing, doll fingers or toes, doll head and eyes or shoes and socks.

SUMMARY OF THE INVENTION

It is therefore a primary object of the present invention to provide an antique doll protection system which simultaneously protects the doll head, hands and fingers, feet and toes, wig, eyes, and clothing, including shoes and socks.

Another object of the present invention is to provide an antique doll protection system which readily identifies to the user the face side and the back side of an antique doll to facilitate proper placement and storage of the doll.

Yet another object of the present invention is to provide an antique doll protection system which can readily and quickly be fitted to or removed from an antique doll without damaging any aspect of the doll or its clothing.

Still another object of the present invention is to provide an antique doll protection system which can be fabricated at comparatively low cost.

Briefly stated, an in accord with one embodiment of the invention, an antique doll protection system accommodates a doll having a body section with first and second sides, a back and a front, a head, a pair of arms, a pair of hands, and a pair of legs with feet having front-facing toes. A protection system includes a body cover having a length and a height which is formed from a padded material with a smooth, low friction inner surface and an outer surface. The length of the body cover is sufficient to enable the body cover to be wrapped around the doll at least one and one half times. The height of the body cover is sufficient to cover at least the body and legs of the doll. The body cover includes first and second sides and upper and lower edges for being wrapped around the doll to form a generally tubular protective wrap. The wrapping of the body cover around the body of the doll begins with the first side of the body cover generally aligned with the first side of the body section of the doll. A first body tie having a first end is secured to the body cover in proximity to the first side of the body cover at a longitudinal location between the upper and lower edges to permit the first body tie to engage and pass around the first side of the body section of the doll. A second body tie includes a first end secured to the inner surface of the body cover at a location laterally inboard and spaced apart from the first body tie at a longitudinal location between the upper and lower edges of the body cover generally aligned with the longitudinal location of the first body tie to permit the second body tie to engage and pass around the second side o the body section of the doll. The first and second body ties include a length sufficient to extend over and across the front of the doll body section and to be secured together to press the back of the doll body section against the underlying part of the body cover to thereby firmly secure the doll to the body cover. Securing means is positionable around the outer surface of the body cover to maintain the body cover tightly wrapped around the doll.

DESCRIPTION OF THE DRAWINGS

The invention is pointed out with particularly in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a preferred hardware embodiment of the invention will now be described in some detail.

Figure 1:
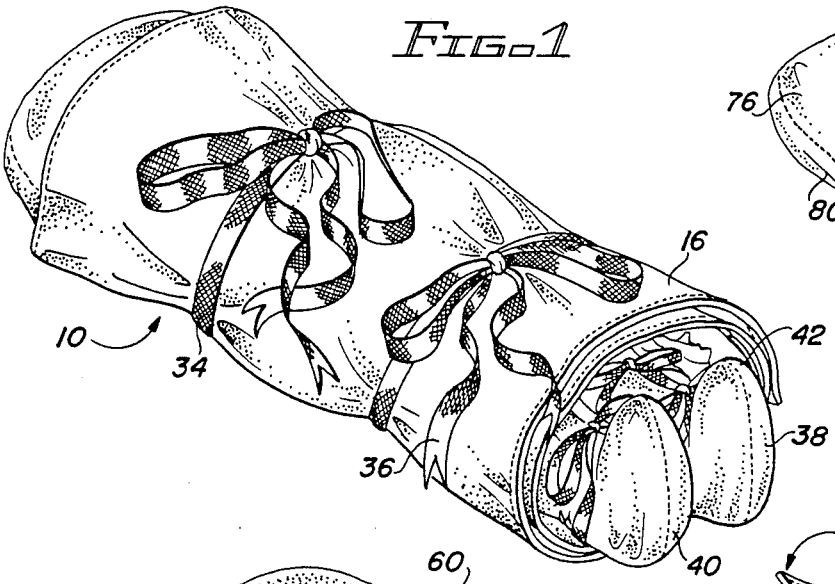
FIG. 1 represents a perspective view of the antique doll protection system depicting it completely wrapped around and secured to an antique doll.
Figure 2:
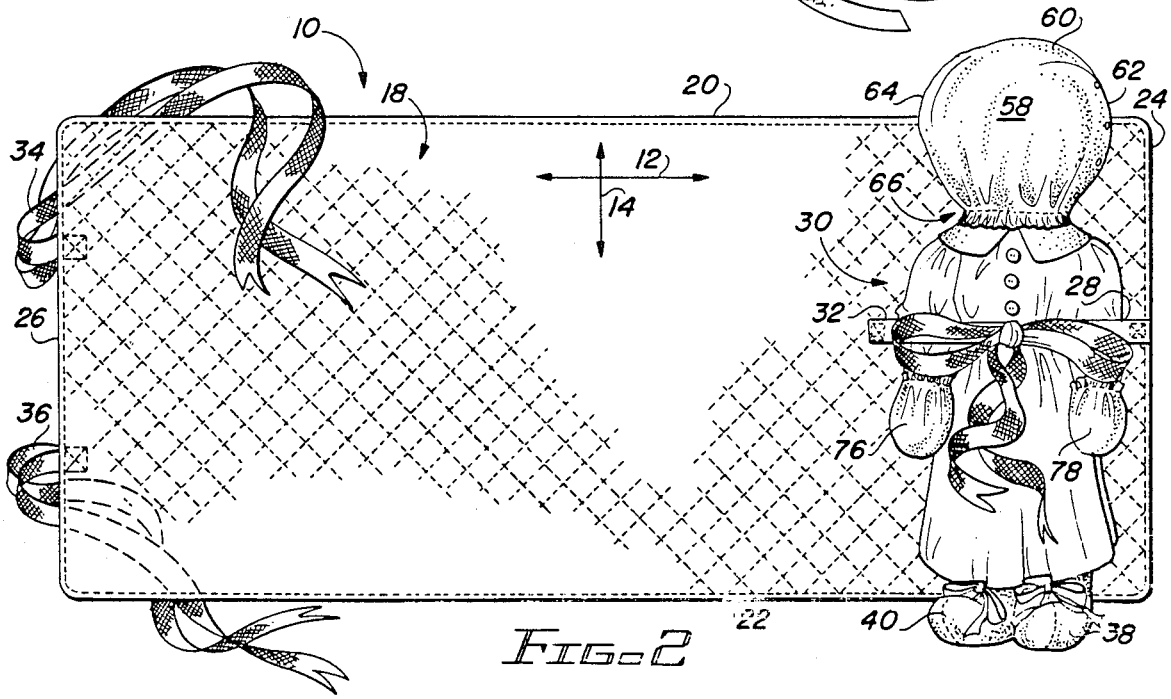
FIG. 2 illustrates the body cover in the unwrapped configuration, particularly illustrating the manner in which the first and second spaced apart body ties pass across and are secured to the body section of the doll.

Referring now to FIGS. 1 and 2, the antique doll protection system includes a body cover 10 which is typically fabricated with a substantially rectangular configuration as illustrated. The length dimension and lateral direction are illustrated generally by reference arrow 12 while the height and longitudinal direction are illustrated by reference number 14. Body cover 10 is most preferably fabricated from a quilted material having an outer layer 16, an intermediate fill layer and an interior layer 18. The material used for the interior layer 18 is typically selected from a group of satin-like cloth materials having a smooth, low friction surface characteristic.

Body cover 10 includes an upper edge 20, a lower edge 22, a first side 24 and a second side 26.

A first body tie 28 is secured to body cover 10 in proximity to first side 24 at a longitudinal location between the upper edge 20 and the lower edge 22 to permit first body tie 28 to engage and pass around the first or right side (when viewed from above) of the upper torso or body section of a doll 30.

A second body tie 32 includes a first end which is secured to the interior layer of the inner surface of body cover 10 at a location laterally inboard and spaced apart from first body tie 28 at longitudinal location between upper edge 20 and lower edge 22 generally aligned with the longitudinal location of the first body tie 28. This location for second body tie 32 enables it to engage and pass around the second or left side (when viewed from above) of the body section of doll 30. First and second body ties 28 and 32 typically fabricated from ribbon and are selected to have a length sufficient to extend over and across the front of the doll body section and to be secured together by tying or other attachment means to depress the back of the doll body section against the underlying part of body cover 10 to thereby firmly secure the doll to the body cover. A variety of other types of adjustable length body ties would readily be apparent to one of ordinary skill in the art. For example, an adjustable length Velcro fastening system could be attached to the loose ends of first and second body ties 28 and 32 to serve as adjustable length fastening or attachment devices for retaining the doll body in a fixed position with respect to body cover 10. Since a Velcro fastening system could snag and damage the doll's dress or wig, this alternative is less desirable than the tie strap preferred embodiment.

A securing means in the form of a first exterior tie strap 34 is secured in proximity to the second side 26 of body cover 10 as illustrated to maintain body cover 10 tightly wrapped around the doll after the body cover has been wrapped around the doll to form a generally tubular protective wrap as illustrated in FIG. 1. Although the preferred form of the invention utilizes two spaced apart exterior tie straps, it would be immediately apparent to one of ordinary skill in the art that only a single exterior tie strap could adequately serve the function of the adjustable securing means of the present invention. In addition, although ribbon has been used to form the first exterior tie strap 34 and the second exterior tie strap 36, an adjustable Velcro attachment system could easily be substituted and function as the securing means of the present invention. With such a Velcro attachment system, either one or two exterior tie straps could be utilized or the appropriate adjustable length Velcro components could be attached to one or more spaced apart locations along the inner surface 18 of body wrap 10 along second side 26 and operate together with a complementary Velcro strip attached to the appropriate point or along an appropriate line on outer layer 16 of body cover 10. Numerous other related forms of securing means could be substituted for the securing means as described above.

Figure 5:
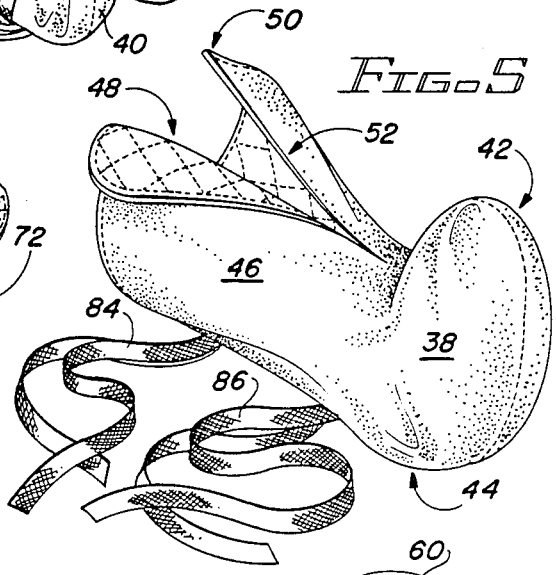
FIG. 5 represents a perspective of one bootlet.

Referring now to FIGS. 1, 2 and 5, an antique doll protection system also includes first and second bootlets 38 and 40. Each bootlet includes an open interior, a toe section 42, a heel section 44 and a lower leg section 46 which is generally aligned with and extends well above the heel section for surrounding and protecting the doll feet, shoes, socks and lower legs. Because antique dolls of the type typically used in connection with a protection system of the present invention include feet having front-facing toes where the toe direction identifies the from or face side of the doll, the orientation of the toe section 42 of bootlets 38 will as illustrated in FIG. 1 readily enable a user to determine whether the doll is being carried and stored in either a face up or face down position.

The lower leg section 46 of first and second bootlets 38 and 40 includes an open top 48 and a front surface 50 which extends downward from top 48. Each bootlet 38 also includes a slit 52 in front surface 50 beginning at top 48 of lower leg section 46 for facilitating removal and installation of the bootlet on the doll feet, whether the feet include shoes or not.

Each bootlet 38 typically also includes first and second spaced apart tie straps 84 and 86 which are coupled to lower leg section 46 to secure the lower leg section to the lower leg of the doll. In the preferred embodiment of the invention as illustrated in FIG. 5, these tie straps are typically made from ribbon, although an adjustable length Velcro attachment or an equivalent adjustable attachment system as described above could readily be substituted for these tie straps.

Figure 3:
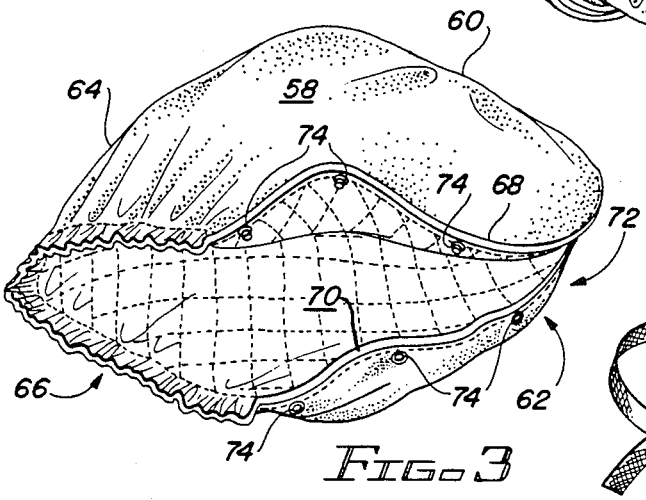
FIG. 3 represents an enlarged perspective view of the head cover of the protection system illustrating the manner in which the head cover can be opened up to install or remove the head cover from the head of the antique doll.

Referring now to FIGS. 2 and 3, the antique doll protective system further includes a head cover 58 having a top 60, a first side 62, a second side 64 and an open neck section and includes an open interior. First side 62 of head cover 58 includes a slit defined by first edge surface 68 and second edge surface 70, each commencing in proximity to neck 66. This slit which is generally designated by arrow 72 extends upward from neck 66 toward the top 60 of head cover 58 to enable the head cover to be opened up and placed entirely around the doll head. The first and second edge surfaces 68 and 70 include complementary fastening devices such as a plurality of spaced apart snaps 74, a Velcro attachment system as described above, a zipper or an equivalent fastening device to enable slit 72 of head cover 58 to be opened and closed to facilitate removal and installation of the head cover over the doll head/wig assembly.

As illustrated in FIG. 2, the neck 68 of head cover 58 is fabricated as a reduced diameter section typically formed as a circular aperture and including an elastic band to create an expandable neck dimension to maintain head cover 58 firmly attached to the doll head. To facilitate installation and removal, the interior surface of head cover 58 is formed from a smooth, low friction material, the head cover itself is fabricated from the same three layer quilted material used for body cover 10.

Figure 4:
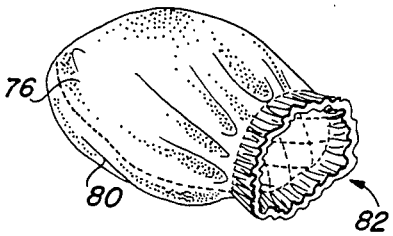
FIG. 4 represents a perspective view of one hand mitt.

Referring now to FIGS. 2 and 4, the antique doll protection system of the present invention further includes first and second hand mitts 76 and 78 each of which includes a body section 80 having an open interior as well as an open neck 82 for surrounding and protecting the hand and fingers of each doll hand. Each hand mitt 76 typically includes an elastic band coupled around the neck 82 for creating an expandable neck dimension and to maintain the reduced diameter configuration of the neck with respect to the body section 80 of each hand mitt 76. To facilitate installation and removal of each hand mitt 76 and to reduce the possibility of damage to the doll hand, the interior surface of the hand mitts is formed from a smooth, low friction material. Each hand mitt is fabricated from a three layer quilted material as was the case with body cover 10.

In view of the detailed description of each element of the antique doll protection system as described above, it should be clear how the carefully selected and implemented design of this invention solves the numerous problems of handling and storing high value antique dolls and either prevents or minimizes breakage, damage or wear to antique dolls and accessories. Due to the comparatively ample hollow interior dimensions of bootlets 38, head cover 58 and hand mitts 76, mechanical strain is not applied to the fragile extremities of an antique doll or to its clothes or accessories during the placement or removal of these elements of the invention. Another advantage of the present invention is that each element of the system is either installed on or removed from the doll after the doll has been placed upon and secured to the interior surface of body cover 10 by body ties 28 and 32. During this installation or removal procedure, the doll remains in a fixed, face up position.

As explained above, it is highly advantageous to store and transport antique dolls in the face-down position to prevent damage to the comparatively heavy doll eyes. Because the configuration of the first and second bootlets 38 and 40 conform to the front-facing foot and toe configuration of the doll itself, and since antique dolls invariably include front-facing feet, the orientation of the bootlets immediately indicates to the user the front and back sides of the antique doll stored within the system of the present invention.

Although the overall height of body cover 10 can either exceed, be equal to or somewhat less than the overall height dimension of the doll, the formation of a tubular package around the doll will always readily enable the user to inspect the orientation of the bootlets and readily identify the front and back sides of the doll wrapped within the body cover.

As illustrated in FIG. 2, the first body tie 28 and second body tie 32 are most preferably positioned even with the doll's upper arm section (the area between the doll's shoulder and elbow) although some variation from this preferred position is acceptable. The longitudinal position of the doll with respect to body cover 10 can be varied to obtain this ideal position of the doll with respect to body ties 28 and 32.

The overall length of body cover 10 is preferably selected to permit the body cover to be wrapped around the doll from at least two to about three times although a minimum length can be selected as long as it has a length sufficient to wrap around the doll at least about one and one half times. After body ties 28 and 32 have been secured to the doll as depicted in FIG. 2, the user places a hand underneath the body cover at a location opposite the back of the doll and circularly rotates the remainder of body cover 10 around the doll. It is not desirable to roll the doll over and over upon a fixed position body 10 as such activity might damage the delicate doll component parts.

After body cover 10 has been completely wrapped around the doll and a tightly wrapped tubular package has been formed, first and second exterior tie straps 34 and 36 are wrapped in opposite directions around the roll of body cover 10 and tightly tied to form a unitary bundle or package which maintains all parts of the doll in a fixed, immobilized position, creating a tight, impact-resistent package. When not in use, bootlets 38 and 40 and hand mitts 76 and 78 can be stored in the open interior of head cover 58.

In one preferred embodiment of the present invention, body cover 10 includes a nineteen inch height measurement and a forty-three inch length measurement. Body ties 28 and 32 are laterally spaced approximately ten inches apart to accommodate the width of most fully dressed antique dolls. A twenty-two inch length for these body ties has been found adequate to accommodate most antique dolls. Exterior tie straps 34 and 36 are fabricated with a length of approximately twenty-six inches to enable these ribbon-like sections to pass twice around the tightly wrapped body cover 10 and to be tied in a bow as illustrated in FIG. 1. First and second tie straps 84 and 86 form a part of each bootlet 38. In the preferred embodiment of the invention, a length of fifteen inches has been found to adequately function in connection with bootlet 38.

It will be apparent to those skilled in the art that the antique doll protection system of the present invention may be modified in numerous other ways and may assume many embodiments other than the preferred forms specifically set out and described above. Accordingly, it is intended by the appended claims to cover all such modifications of the invention which fall within the true spirit and scope of the invention.

I claim:

1. A protection system for a doll having a body section with first and second sides, a back and a front, a head, a pair of arms, a pair of hands, and a pair of legs with feet having front-facing toes, comprising:

a. body cover having a length and a height and being formed from a padded material with a smooth, low friction inner surface and an outer surface, the length of the body cover being sufficient to enable the body cover to be wrapped around the doll at least one and one half times and the height being sufficient to cover at least the body and legs of the doll, the body cover including first and second sides and upper and lower edges for being wrapped around the doll to form a generally tubular protective wrap, the wrapping of the body cover around the body of the doll beginning with the first side of the body cover generally aligned with the first side of the body section of the doll;

b. a first body tie having a first end secured to the body cover in proximity to the first side of the body cover at a longitudinal location between the upper and lower edges to permit the first body tie to engage and pass around the first side of the body section of the doll;

c. a second body tie having a first end secured to the inner surface of the body cover at a location laterally inboard of and spaced apart from the first body tie at a longitudinal location between the upper and lower edges of the body cover generally aligned with the longitudinal location of the first body tie to permit the second body tie to engage and pass around the second side of the body section of the doll, the first and second body ties having a length sufficient to extend over and across the front of the doll body section and to be secured together to press the back of the doll body section against the underlying part of the body cover to thereby firmly secure the doll to the body cover; and d. securing means positionable around the outer surface of the body cover for maintaining the body cover tightly wrapped around the doll.

2. The protection system of claim 1 wherein the securing means includes a first exterior tie strap secured in proximity to the second side of the body cover.

3. The protection system of claim 2 further including a second exterior tie strap secured in proximity to the second side of the body cover, wherein the first and second exterior tie straps are longitudinally spaced apart from each other.

4. The protection system of claim 1 further including first and second bootlets each including an open interior, a toe section, a spaced apart heel section and a lower leg section generally aligned with an extending above the heel section for surrounding and protecting the doll feet and lower legs and for enabling a user to visually identify the front and back sides of the doll wrapped within the body cover.

5. The protection system of claim 4 wherein the lower leg section of the first and second bootlets includes an open top and a front surface extending downward from the top.

6. The protection system of claim 5 wherein each bootlet includes a slit in the front surface beginning at the top of the lower leg section for facilitating removal and installation of the bootlet on the doll feet.

7. The protection system of claim 5 wherein the first and second bootlets each further include first and second tie straps coupled to the lower leg section of the bootlet for securing the lower leg section to the lower leg of the doll.

8. The protection system of claims 1 or 4 further including a head cover having a top, first and second sides and an open neck section and defining an open interior, the first side including a slit defined by first and second edge surfaces commencing at the neck section and extending upward toward the top of the head cover for enabling the head cover to be opened up and placed entirely around the doll head, the first and second edge surfaces including fastening devices for enabling the head cover slit to be opened and closed.

9. The protection system of claim 8 wherein the neck section of the head cover is dimensioned to prevent easy removal of the head cover from the doll head when the slit is closed.

10. The protection system of claim 9 wherein the neck section defines a substantially circular aperture and wherein an elastic band is coupled around the head cover neck section to create an expandable neck dimension.

11. The protection system of claims 1, 4 or 8 further including first and second hand mitts each including a body section having an open interior and an open neck for surrounding and protecting a single doll hand.

12. The protection system of claim 11 wherein each of the hand mitts includes an elastic band coupled around the neck for creating an expandable neck dimension.

13. The protection system of claim 12 wherein the interior surface of the first and second hand mitts is formed from a smooth, low friction material.

14. The protection system of claim 7 wherein the first and second tie straps are fabricated from ribbon.

15. The protection system of claim 1 wherein the first and second body ties are fabricated from ribbon.

16. The protection system of claim 1 wherein the body cover is fabricated from a quilted material having an outer layer, an intermediate fill layer and an interior layer, wherein the interior layer is fabricated from a satin-like material having a smooth, low friction surface.

* * * * *